US009410230B2

(12) United States Patent
Theisen et al.

(10) Patent No.: US 9,410,230 B2
(45) Date of Patent: Aug. 9, 2016

(54) POWDER-METALLURGICALLY PRODUCED, WEAR-RESISTANT MATERIAL

(71) Applicant: KOPPERN ENTWICKLUNGS GMBH & CO. KG, Hattingen (DE)

(72) Inventors: Werner Theisen, Hattingen (DE); Andreas Packeisen, Gladbeck (DE); Hans Berns, Hattingen (DE)

(73) Assignee: KOPPERN ENTWICKLUNGS GMBH & CO. KG, Hattingen (DE)

( * ) Notice: Subject to any disclaimer, the term of this patent is extended or adjusted under 35 U.S.C. 154(b) by 0 days.

(21) Appl. No.: 13/683,971

(22) Filed: Nov. 21, 2012

(65) Prior Publication Data

US 2013/0084462 A1 Apr. 4, 2013

Related U.S. Application Data

(62) Division of application No. 11/912,829, filed as application No. PCT/EP2006/004086 on May 2, 2006, now abandoned.

(30) Foreign Application Priority Data

Apr. 29, 2005 (DE) ..... 10 2005 020 081

(51) Int. Cl.
*C22C 38/36* (2006.01)
*C22C 38/58* (2006.01)
(Continued)

(52) U.S. Cl.
CPC ..... *C22C 38/58* (2013.01); *C22C 30/00* (2013.01); *C22C 33/0285* (2013.01);
(Continued)

(58) Field of Classification Search
CPC ..... C22C 33/0285
USPC ..... 420/12
See application file for complete search history.

(56) References Cited

U.S. PATENT DOCUMENTS 3,929,518 A 12/1975 Akahori et al.
4,140,527 A 2/1979 Kawai et al.
(Continued)

FOREIGN PATENT DOCUMENTS

DE 2937724 4/1980
DE 3508982 9/1986
(Continued)

OTHER PUBLICATIONS

International Preliminary Report on Patentability based on International Application PCT/EP2006/004086; International Filing Date: Feb. 5, 2006; Date of Issuance: May 18, 2007.
(Continued)

*Primary Examiner* — Jessee Roe
*Assistant Examiner* — Christopher Kessler
(74) *Attorney, Agent, or Firm* — Marshall, Gerstein & Borun LLP

(57) ABSTRACT

A wear-resistant material comprising an alloy that contains: 1.5-5.5 wt. % carbon, 0.1-2.0 wt. % silicon, max. 2.0 wt. % manganese, 3.5-30.0 wt. % chromium, 0.3-10 wt. % molybdenum, 0-10 wt. % tungsten, 0.1-30 wt. % vanadium, 0-12 wt. % niobium, 0.1-12 wt. % titanium and 1.3-3.5 wt. % nickel, the remainder being comprised of iron and production-related impurities, whereby the carbon content fulfills the following condition:

$$C_{Alloy}[w\ \%]=S1+S2+S3$$

where $S1=(Nb+2(Ti+V-0.9))/a$, $S2=(Mo+W/2+Cr-b)/5$, $S3=c+(TH-900)\cdot 0.0025$, where $7<a<9$, $6<b<8$, $0.3<c<0.5$ and $900°\ C.<TH<1{,}220°\ C.$

19 Claims, 5 Drawing Sheets

(51) Int. Cl.

| | |
|---|---|
| ***C22C 33/02*** | (2006.01) |
| ***C22C 38/02*** | (2006.01) |
| ***C22C 38/44*** | (2006.01) |
| ***C22C 38/46*** | (2006.01) |
| ***C22C 38/50*** | (2006.01) |
| ***C22C 38/56*** | (2006.01) |
| ***C22C 30/00*** | (2006.01) |
| ***C22C 38/00*** | (2006.01) |
| ***C22C 38/34*** | (2006.01) |
| ***C22C 38/48*** | (2006.01) |
| ***C22C 38/52*** | (2006.01) |

(52) U.S. Cl.

CPC ..... *C22C 38/001* (2013.01); *C22C 38/02* (2013.01); *C22C 38/34* (2013.01); *C22C 38/44* (2013.01); *C22C 38/46* (2013.01); *C22C 38/48* (2013.01); *C22C 38/50* (2013.01); *C22C 38/52* (2013.01); *C22C 38/56* (2013.01); *B22F 2998/10* (2013.01); *B22F 2999/00* (2013.01); *Y10T 428/12* (2015.01)

(56) References Cited

U.S. PATENT DOCUMENTS

| | | | |
|---|---|---|---|
| 5,458,703 | A | 10/1995 | Nakai |
| 5,900,560 | A | 5/1999 | Pinnow et al. |
| 6,723,185 | B1 | 4/2004 | Elfving et al. |

FOREIGN PATENT DOCUMENTS

| | | | |
|---|---|---|---|
| DE | 4202828 | | 8/1993 |
| DE | 10305568 | | 8/2003 |
| EP | 0515018 | A1 | 11/1992 |
| EP | 0-785 288 | A1 | 7/1997 |
| EP | 1249512 | | 10/2002 |
| JP | 01-275742 | | 11/1989 |
| JP | 03257144 | | 11/1991 |
| JP | 07-166300 | | 6/1995 |
| JP | 2004238721 | A | 8/2004 |
| WO | WO-9524513 | A1 | 9/1995 |

OTHER PUBLICATIONS

Berns, Hans, and Werner Theisen. *Ferrous Materials: Steel and Cast Iron*. Berlin: Springer, 2008.

POWDER-METALLURGICALLY PRODUCED, WEAR-RESISTANT MATERIAL

CROSS-REFERENCE TO RELATED APPLICATION

This application is a divisional of U.S. patent application Ser. No. 11/912,829, now abandoned, which is the U.S. national stage of International Patent Application No. PCT/EP2006/004086 filed on May 2, 2006, which application claims priority of German Patent Application No. 10 2005 020 081.8 filed Apr. 29, 2005. The entire text of the priority applications are incorporated herein by reference in their entireties.

FIELD OF THE DISCLOSURE

The disclosure relates to a powder-metallurgically produced, wear-resistant material from an alloy, as well as to a method for producing the material, the use of said material and a powder material.

BACKGROUND

Wear-resistant alloys on the basis of iron are widely used. In this connection, the resistance to wear is achieved from the hardness of the martensitic metal matrix and the content of hard carbides, nitrides or borides of the elements chromium, tungsten, molybdenum, vanadium, niobium or titanium. This group includes cold work steel and high-speed tool steels, as well as white cast iron and hardfacing alloys.

Powder-metallurgical steel alloys were developed when striving for fine carbides, their homogenous distribution and high contents, in order to improve the resistance to wear. The starting powder of these materials is an alloyed powder that is created by atomizing a melt. Normally powders of this type are filled into thin sheet metal capsules that are compacted into a dense body after the evacuation and seal welding in special autoclaves, using the hot isostatic pressing (HIP) technique at a temperature below the melting point and at an isostatic gas pressure of up to 2,000 bar. By means of subsequent hot working (forging or rolling), the compacted capsules are reworked into semi-finished products of tool steel that are available on the market in various dimensions. Generally tools are produced from these semi-finished products, whereby these tools obtain their service hardness by means of a heat treatment known as hardening. The hardening consists of austenitizing and cooling at such a speed that predominantly a hard martensitic structure is formed. As the wall thickness of the workpiece increases, the cooling speed needed for this is no longer reached in the core and the high degree of hardness of the martensite can be regulated only down to a certain depth in the workpiece. This is called the effective hardening depth. In this case, the core is not through-hardened.

A multitude of powder compositions for wear-resistant materials are known, but these generally are not sufficient for thick-walled composite parts as far as their through-hardening characteristics are concerned. By way of example in this connection, mention is made of a steel matrix hard material composite material, disclosed in DE 3508982, as well as a powder-metallurgically produced steel product with a high vanadium-carbide content, as described in DE 2937724 and EP 0515018.

HIP technology can be used for more than just the production of semi-finished products made of powder-metallurgically produced steel; it is also suitable for applying a layer produced from powder with a thickness in the mm to cm range onto an economical, usually resistant steel substrate. This technology, known as HIP cladding, is being more and more widely used for the production of components that are subject to heavy wear and that are used in processing technology and polymer processing. Some examples of substances used in this case as wear-resistant layer substances are atomized steel powder, to which hard material powder is additionally added in some cases, with a view to a high level of wear-resistance. In this way, today even workpieces with extremely wear-resistant layers can be provided that greatly surpass, as far as the life cycle is concerned, the conventional wearing components not produced in the powder-metallurgical manner. New HIP systems are being made for larger and larger components, which consequently also have larger and larger wall thicknesses. This leads to the development of the problem of insufficient hardening for the heat treatment of the larger-walled composite parts after the HIP step.

The objective of this heat treatment is the martensitic through-hardening of the layer substance, which, in operation, is largely consumed by wear and which consequently must be through-hardened. Because of the high risk of cracks and distortions in alloys containing hard material and the sudden cooling in water or oil, these cooling media are ruled out, particularly in the case of thick wall thicknesses, because of the associated large thermal tensions. For this reason, there is a demand for layer substances that can be converted to the martensite phase that is needed for a high level of wear-resistance, even in the case of the slow cooling of large composite components, e.g., in the air, vacuum ovens with nitrogen pressure <6 bar or in the HIP system. The steel powders known today are not suitable for this purpose, because they have been optimised for semi-finished products and workpieces with smaller wall thicknesses.

SUMMARY OF DISCLOSURE

The object of the present disclosure is therefore to provide alloys for the production of materials that allow for their matrix to be converted into hard, wear-resistant martensite, even in the event of very slow cooling.

This object is solved by means of a wear-resistant material comprising an alloy that contains: 1.5-5.5 wt. % carbon, 0.1-2.0 wt. % silicon, max. 2.0 wt. % manganese, 3.5-30.0 wt. % chromium, 0.3-10 wt. % molybdenum, 0-10 wt. % tungsten, 0.1-30 wt. % vanadium, 0-12 wt. % niobium, 0.1-12 wt. % titanium and 1.3-3.5 wt. % nickel, the remainder being comprised of iron and production-related impurities, whereby the carbon content fulfils the following condition:

$$C_{Alloy}[w\ \%]=S1+S2+S3$$

where $S1=(Nb+2(Ti+V-0.9))/a$, $S2=(Mo+W/2+Cr-b)/5$, $S3=c+(TH-900)\cdot 0.0025$, where $7<a<9$, $6<b<8$, $0.3<c<0.5$ and $900°\ C.<TH<1{,}220°\ C$. In this case, TH is the hardening temperature.

The alloy content in the metal matrix is decisive for achieving the martensitic structure even in the event of slow cooling. In principle, all alloy elements that are dissolved in the metal matrix and that shift the "perlite notch" to the right in the time-temperature transformation diagram (TTT diagram) shown in the following have a favorable effect. In addition to carbon, this includes the elements chromium, molybdenum and vanadium, but particularly nickel, which is used in the alloys according to the disclosure for this reason. Although the austenite-stabilizing effect of nickel is known, it has not been used to any appreciable degree in the PM alloys known until now. The regulation of a desired nickel content in the metal matrix is relatively simple, because nickel does not participate in the carbide formation necessary for a high level of wear-resistance. Because of the presence of the carbides deposited from the melt, the nickel content is somewhat higher in the matrix than in the alloy. The nickel content primarily acts in the metal matrix and increases the austenite range as the content increases. It can be assumed that the nickel content in the metal matrix per volume percent of carbide lies above the content of nickel in the alloy by 0.025 wt %. The austenite-stabilizing effect of the nickel makes it possible to convert the alloys into the hard, wear-resistant martensite, even in the case of very slow cooling.

Because in addition to the nickel content, the carbon is particularly significant for the austenite stabilization, but particularly due to the fact that this is bound in various carbide types to various degrees, it must be related to the remaining alloy elements with a view to the desired hardenability. In this process, the C content calculated in the summands S1 and S2 stands for the proportion of carbon that is indissolubly bound in the various carbide types.

The summand S3 represents a portion of carbon that can be dissolved, if there is sufficient molybdenum content in the alloy, by means of the selection of the austenitizing temperature in the metal matrix. As the hardening temperature increases, more molybdenum-containing carbides are dissolved. As a result, the austenite becomes richer in molybdenum and carbon, which expand the austenite range and consequently increase the critical cooling rate.

The factors a, b and c were introduced because the carbide formation functions with each of the elements Cr, Mo, V and W in a certain bandwidth.

The dimensioning of the other elements mentioned, which shift the "perlite notch" in the time-temperature transformation diagram (TTT diagram) to the right, is very much more complex, because on the one hand, one portion of these is hardened into carbides that are deposited from the melt and that can no longer be dissolved, and another portion is hardened into carbides that can be dissolved again during the hardening.

The material according to the disclosure can be economically hardened by known measures, whereby even thick-walled components are through-hardened without increased costs.

Advantageously, the wear-resistant material can be made of an alloy with the chemical composition: 1.5-5.5 wt. % carbon, 0.1-2.0 wt. % silicon, max. 2.0 wt. % manganese, 3.5-30.0 wt. % chromium, 0.3-10 wt. % molybdenum, 0-10 wt. % tungsten, 0.1-30 wt. % vanadium, 0-12 wt. % niobium, 0.1-12 wt. % titanium and 1.3-3.5 wt. % nickel, the remainder being comprised of iron and production-related impurities, whereby the carbon content fulfils the following condition:

$$CAlloy[w\ \%]=S1+S2+S3$$

where $S1=(Nb+2(Ti+V-0.9))/a$, $S2=(Mo+W/2+Cr-b)/5$, $S3=c+(TH-900)\cdot 0.0025$, where $7<a<9$, $6<b<8$, $0.3<c<0.5$ and 900° C.<TH<1,220° C. In this case, TH is the hardening temperature. This alloy has proven particularly satisfactory in practice.

According to a preferred embodiment, the proportion of vanadium in the alloy of the wear-resistant material can be less than 11.5 wt. %, preferably less than 9.5 wt. %, and particularly preferably less than 6.0 wt. %. In this case, it is particularly preferred if the volume content of the vanadium carbide in the alloy amounts to less than 18.5 vol. %. Corresponding ranges have proven particularly suitable in the implementation of the disclosure.

According to another preferred embodiment, the alloy of the wear-resistant material can comprise 2.0-2.5 wt. % carbon, max. 1.0 wt. % silicon, max. 0.6 wt. % manganese, 12.0-14.0 wt. % chromium, 1.0-2.0 wt. % molybdenum, 1.1-4.2 wt. % vanadium and 2.0-3.5 wt. % nickel, the remainder being comprised of iron and unavoidable impurities. This specific composition has proven particularly satisfactory in practice.

The alloy can advantageously additionally have 1-6 wt. % Co.

According to a further preferred embodiment, the alloy can additionally have 0.3 to 3.5 wt. % N. In some applications, the addition of nitrogen has proven advantageous.

The proportion of nickel can advantageously amount to between 2.0 and 3.5%. In practice, a corresponding nickel content has proven to be particularly suitable, particularly in quenching the material with static air.

According to a further embodiment of the present disclosure, the Ni content can lie between 1.3 and 2.0%. An alloy with a corresponding nickel content is particularly suitable for cooling by means of gas ≤6 bar. For higher quenching pressures, a Ni content of 1.0 to 1.3% is suitable.

The wear-resistant material can advantageously fulfill the condition:

$CAlloy\ [w\ \%]=S1+S2K+S3$, where $S2K=(Mo+W/2+Cr-b-12)/5$ with $6<b<8$ and $Cr>12$. This condition can particularly be used in the case that a corrosion-resistant alloy is desired. In this case, there is a prerequisite that a minimum chromium content of 12% is dissolved in the metal matrix. In this case, for the summand S2 of the above equation the summand S2K is used, which takes the necessary chromium content into consideration.

According to a further preferred embodiment, the wear-resistant material can be produced by means of a method whereby first a melt is produced and the melt is further processed by means of one of the following methods: atomization of the melt into a powder or spray compaction of the melt. The material according to the disclosure can therefore be produced by means of various methods, and so allows, firstly, the manufacture of powders and, secondly, by the use of spray compaction, the production of a very wide range of semi-finished products, as well as end products.

Another preferred embodiment comprises a production method in which first a melt is formed and then this melt is cast into a semi-finished product, whereby the semi-finished product is further processed for creating chips and/or powder.

The powder can advantageously be compacted into a semi-finished product or end product under high pressure and/or increased temperature. A number of possible compaction methods again present themselves here, with cold isostatic pressing, uniaxial pressing, extrusion, powder forging, hot isostatic pressing, diffusion alloying and sintering being named as examples. In practice, it is consequently possible to select a suitable method without limitation in order to produce an end product.

The powder can also advantageously be further processed by means of thermal injection.

According to an additional preferred embodiment, the semi-finished product or an end product can be heated to the hardening temperature and subsequently quenched. In this case, a method for quenching can be chosen from the group comprising: quenching in an oil bath, salt bath or polymer bath, quenching in a fluidized bed or drizzle and low and high pressure gas quenching.

According to an additional preferred embodiment, the semi-finished product or an end product can be heated to the hardening temperature and subsequently cooled. Included among the preferred methods for cooling in this case are cooling in slightly moving air, cooling in static air, oven cooling in a standard atmosphere or inert gas and cooling in an HIP system.

The quenching or cooling in this connection primarily serves the purposes of hardening.

The cooling can advantageously be interrupted by an isothermal maintenance stage (interrupted hardening).

Preferably, following the cooling from the hardening temperature, tempering in the temperature range 150-750° C. can be performed one or more times, in order to achieve a desired combination of characteristics with respect to hardness and toughness.

According to a preferred utilization, the material according to the disclosure is used as a powder. In the form of a powder, the material can be converted into a desired semi-finished product form or end form by means of a multitude of various methods. This also includes use in the form of a layer element of composite components, particularly also as a matrix powder for hard material metal matrix composites.

One application area is the utilization of the wear-resistant material for the production of solid and hollow rolls. Some of the uses of corresponding rolls are for the purpose of crushing, briquetting and compacting natural, chemical or mineral feedstocks, particularly cement clinker, ore and stone. Furthermore, corresponding rolls can also be used for the purpose of the movement and transport of products that promote wear, particularly of metallic rolled and forged products.

A further application area is the use of the wear-resistant material for producing rings which are arranged on solid or hollow roll bodies. In this case, only an outer layer is made of the wear-resistant material, not the entire roll. Corresponding rolls can be deployed in the same scope of functions mentioned above.

Solid or segmented rings made of the wear-resistant material can be advantageously arranged on solid or hollow rolls by means of shrinking them on. This is a proven method in practice for placing the rings.

The wear-resistant material can advantageously be used for producing thick-walled or compact components. Corresponding components can, for example, be used in the area of wear protection in extraction and processing, as well as in the transport of natural, chemical or mineral goods, as well as metallic goods, polymer goods and ceramic goods.

According to a further preferred embodiment, the disclosure relates to a powder for the production of a wear-resistant material comprising: 1.5-5.5 wt. % carbon, 0.1-2.0 wt. % silicon, max. 2.0 wt. % manganese, 3.5-30.0 wt. % chromium, 0.3-10 wt. % molybdenum, 0-10 wt. % tungsten, 0.1-30 wt. % vanadium, 0-12 wt. % niobium, 0.1-12 wt. % titanium and 1.3-3.5 wt. % nickel, the remainder being comprised of iron and production-related impurities, whereby the carbon content fulfils the following condition:

$$CAlloy[w\ \%]=S1+S2+S3$$

where: $S1=(Nb+2(Ti+V-0.9))/a$, $S2=(Mo+W/2+Cr-b)/5$, $S3=c+(TH-900)\cdot 0.0025$, where $7<a<9$, $6<b<8$, $0.3<c<0.5$ and $900°\ C.<TH<1{,}220°\ C.$ According to a further preferred embodiment, the disclosure relates to a powder for the production of a wear-resistant material with the following chemical composition: 1.5-5.5 wt. % carbon, 0.1-2.0 wt. % silicon, max. 2.0 wt. % manganese, 3.5-30.0 wt. % chromium, 0.3-10 wt. % molybdenum, 0-10 wt. % tungsten, 0.1-30 wt. % vanadium, 0-12 wt. % nio-bium, 0.1-12 wt. % titanium and 1.3-3.5 wt. % nickel, the remainder being comprised of iron and production-related impurities, whereby the carbon content fulfils the following condition:

$$CAlloy[w\ \%]=S1+S2+S3$$

where: $S1=(Nb+2(Ti+V-0.9))/a$, $S2=(Mo+W/2+Cr-b)/5$, $S3=c+(TH-900)\cdot 0.0025$, where $7<a<9$, $6<b<8$, $0.3<c<0.5$ and $900°\ C.<TH<1{,}220°\ C.$ A corresponding composition has proven particularly satisfactory in practice.

The powder can advantageously be used as a semi-finished product. One result of this is to make it possible for a buyer to convert the semi-finished product into the desired end form.

A further application area is the use of the powder in powder form or as a semi-finished product as a layer substance or layer element of composite components.

Another further application area is the use of the powder as a matrix powder for hard material metal matrix composite elements. Corresponding hard material metal matrix composite elements are particularly suitable for the production of semi-finished products and composite components.

BRIEF DESCRIPTION OF THE DRAWINGS

A preferred embodiment of the present disclosure is explained in the following using a drawing, but this is not intended to restrict the scope of the disclosure.

Shown are.

DETAILED DESCRIPTION

The heat treatment characteristic of hardenable steels and alloys is generally evaluated on the basis of time-temperature transformation diagrams (TTT diagrams). The TTT diagram shown in FIG. 1 serves to compare an alloy according to the disclosure with a commercially available powder metallurgical steel with the composition X230CrVMo13-4 (material no. 1.2380). Because the martensite formation for the mentioned material group is indispensable, the cooling from the hardening temperature (in this case, 1,050° C.) must take place so quickly that the ferrite and perlite soft structure phases are avoided in the layer substance. For this reason, the cooling rate deserves increased attention, which is described in heat treatment technology by the cooling time from 800° C. to 500° C. The cooling parameter λ, which is noted as a numerical value for several cooling curves in FIG. 1, is formed by dividing the cooling time (in seconds) by 100.

Figure 1A:
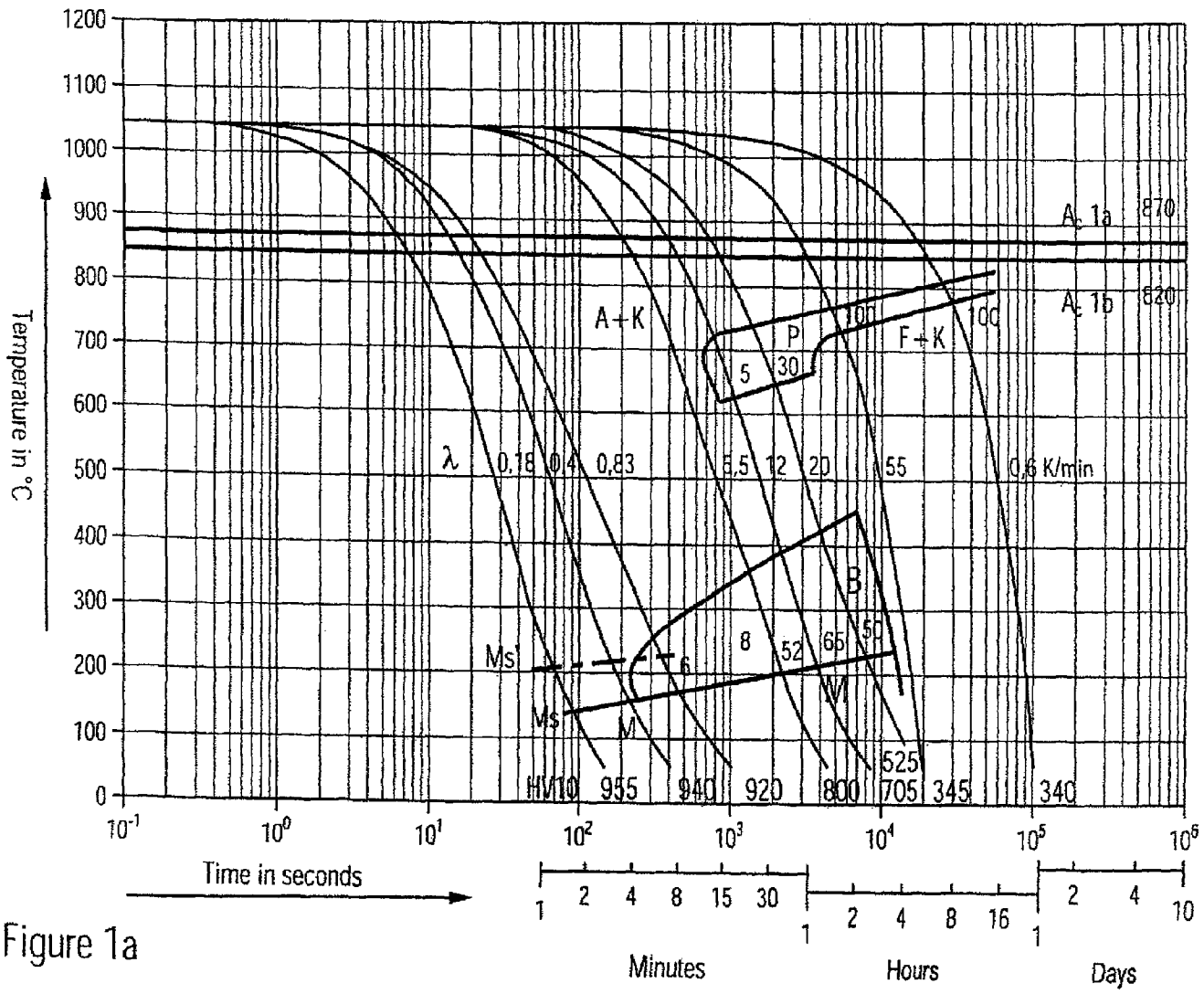
FIG. 1*a* and FIG. 1*b*: Time-temperature transformation diagram (TTT diagram) of an alloy according to the disclosure (PM1) as well as a commercially available PM steel.

From the TTT diagram for the steel X230CrVMo13-4 shown in FIG. 1*a*, it can be seen that the high level of hardness needed for a high level of wear resistance can only be reached in a component in areas in which the cooling parameter $\lambda<9$. For example, cooling with $\lambda=55$ provides a hardness of only 345 HV30, but such a hardness level is completely inadequate for applications as a tool. Because λ is greater in the interior of thick-walled components than at the edge, and it additionally depends on the cooling medium, the through-hardening characteristic of steel is often described with the example of a cylindrical body. The heat transfer upon quenching in various media (air, oil, water) is known for this simple geometry, so that λ values can be given for the interior of the cylinders. With λ=9 as the limiting value for the critical cooling rate for powder-metallurgical steel X230CrVMo13-4, this steel can be through-hardened under the basic conditions given in the following Table 1. The table does not contain any information on water quenching, because this method does not come into consideration technically because of the expected hardening cracks resulting from cooling that is too brusque.

Figure 1B:
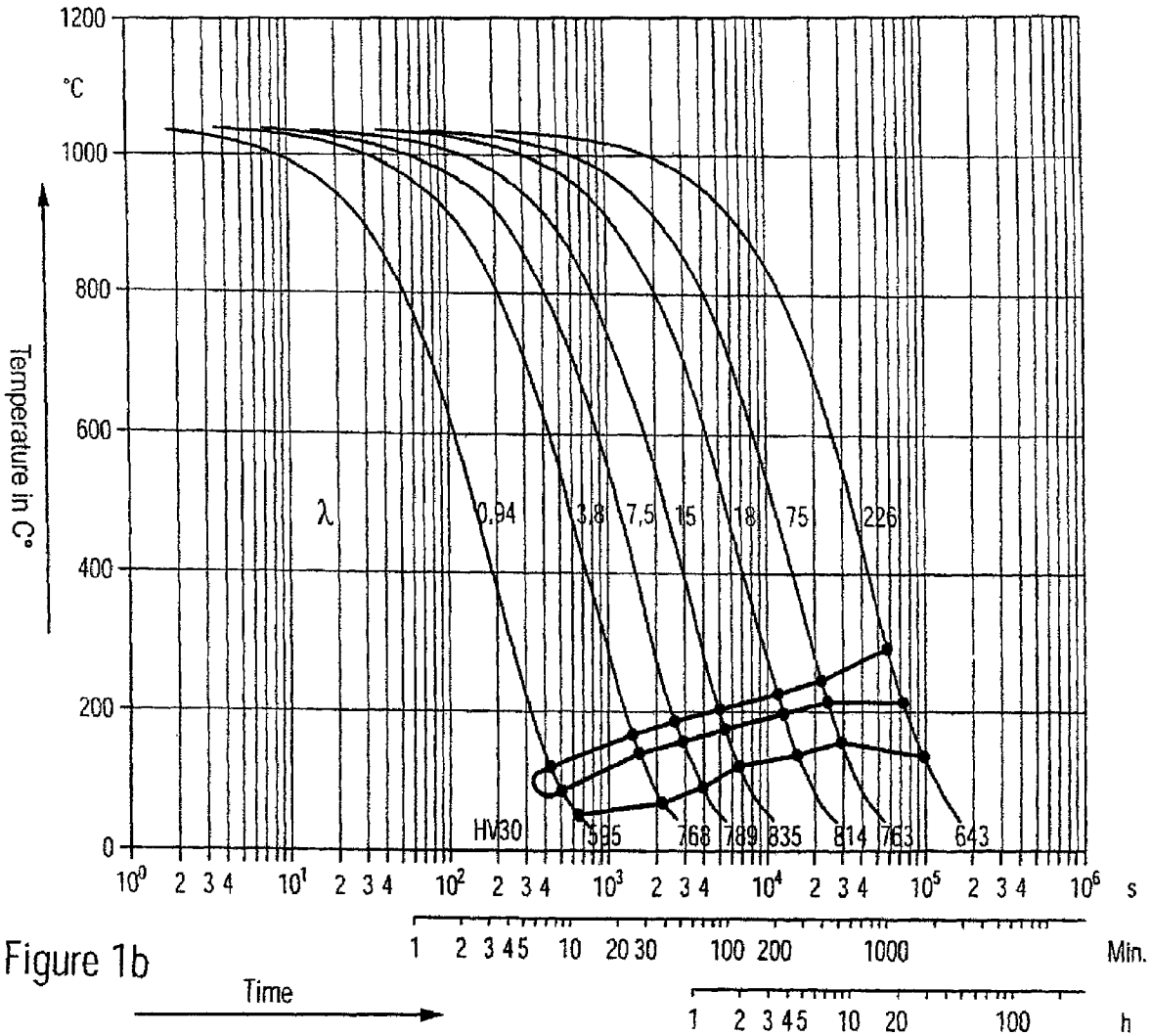

The mode of operation of the alloy according to the disclosure and particularly the addition of nickel and molybdenum can be described using the TTT diagram in FIG. 1*b*, which was determined for an alloy variant PM1 with 12.5% Cr, 3% Ni, 1.5% V, 2% Mo, 2.5% C and 0.2% Ti, with the remainder iron (X250CrNiVMo13-3-2-2). Compared to the conventional nickel-free steel X230CrVMo13-4, the perlite field is shifted far to the right on the logarithmically depicted time axis due to the addition of nickel and molybdenum, and the beginning of the martensitic transformation (martensite start temperature) is shifted downwards. The addition of nickel and molybdenum, in conjunction with a high hardening temperature, leads to an increase in the residual austenite, because the martensite finish temperature is pressed further down below room temperature.

This results in advantages with regard to the heat treatment that have not yet been achieved with conventional powder-metallurgical alloys. The hardness values assigned to the cooling curves confirm that the soft, perlitic structure, for example, at λ=55, can be avoided with the alloy shown here by way of example. FIG. 1*b* shows a macro-hardness between 763 and 814 HV30 for such cooling of the alloy PM1, in comparison to the hardness of the conventional powder-metallurgical steel of only 345 HV30. Therefore, considerably larger layer or wall thicknesses can also be through-hardened in air, without it being necessary to call on brusque quenching means (Table 1). The vacuum hardening with compressed gas quenching frequently used today can be replaced with the considerably more economical and also safe cooling in static air.

Furthermore, when the HIP technology is used, the alloys according to the disclosure open up the possibility of martensitically hardening even thick-walled components with the normally existing slow cooling from the HIP temperature (λ approximately 130) (see FIG. 1*b*). By means of this measure, the process of the subsequent, expensive vacuum hardening can be completely spared. Because in many HIP systems, the cooling can also take place under pressure, isostatic pressure can additionally be used against the risk of cracks, which increases with the hard-phase content.

Steels that are alloyed with chromium, vanadium and molybdenum and that have sufficient C content can be secondarily hardened by tempering above 500° C. This allows the transformation of the remaining residual austenite by repeated tempering in the range of the secondary hardness maximum.

Figure 2:
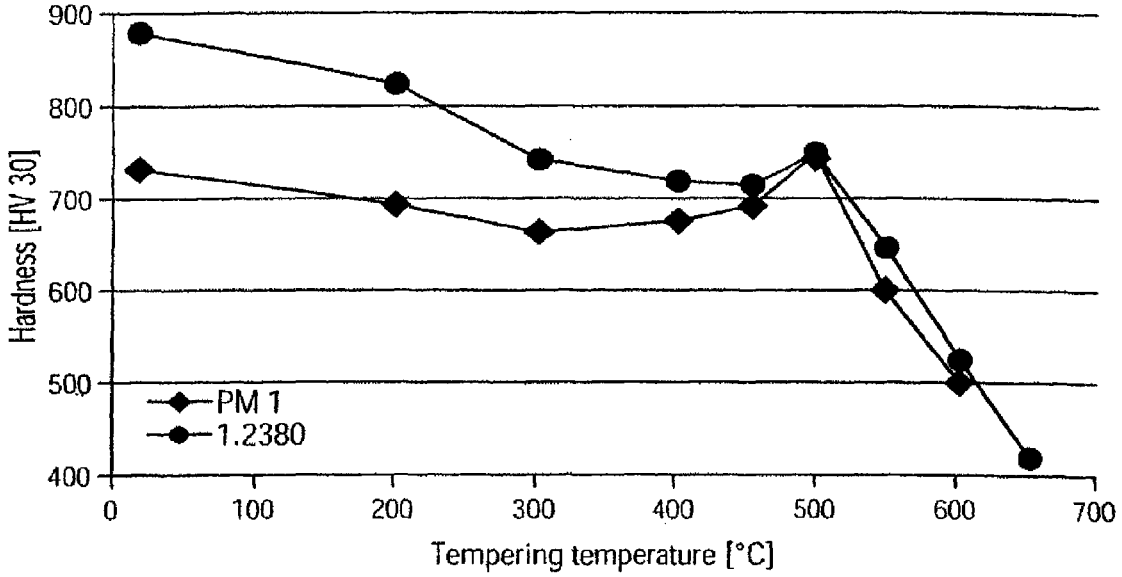
FIG. 2: Hardness tempering temperatures of an alloy according to the disclosure (PM1) as well as a commercially available PM steel (X230CrVMo13-4)

In this connection, FIG. 2 shows hardness tempering curves for the PM steel X230CrVMo13-4 and for a variant PM1 alloyed according to claim 1. While the commercially available powder-metallurgical steel was hardened in oil with A>9 because of the desired quick cooling, the steel PM1 according to the disclosure was cooled with a value of approximately 80 for λ. Although the hardness after quenching is somewhat less in the alloy according to the disclosure than in the conventional comparison steel due to the high residual austenite content, the same hardness is reached as in the conventional steel by means of repeated tempering in the range of the secondary hardness maximum and the residual austenite transformation and special carbide precipitation associated with this.

Figure 3A:
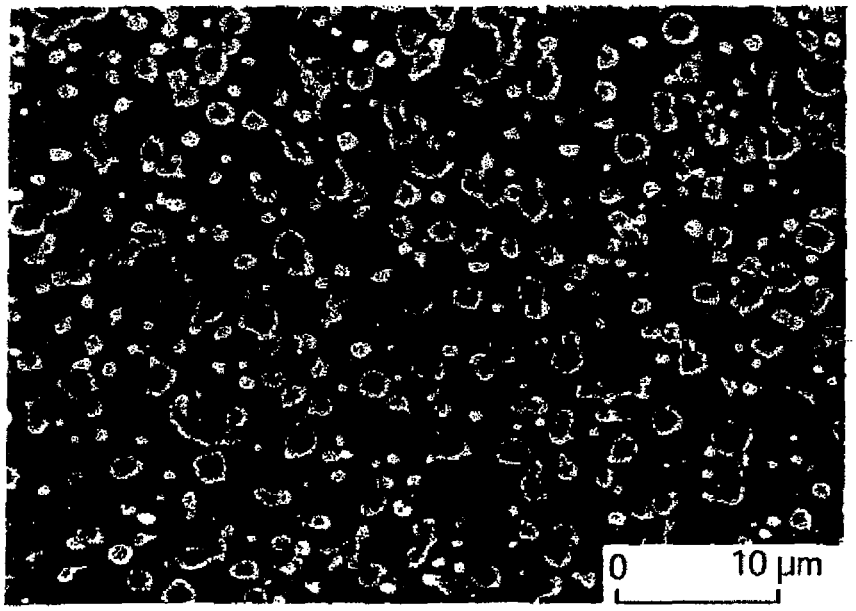
FIG. 3*a*: The structure of a commercially available PM steel (X230CrVMo13-4)
Figure 3B:
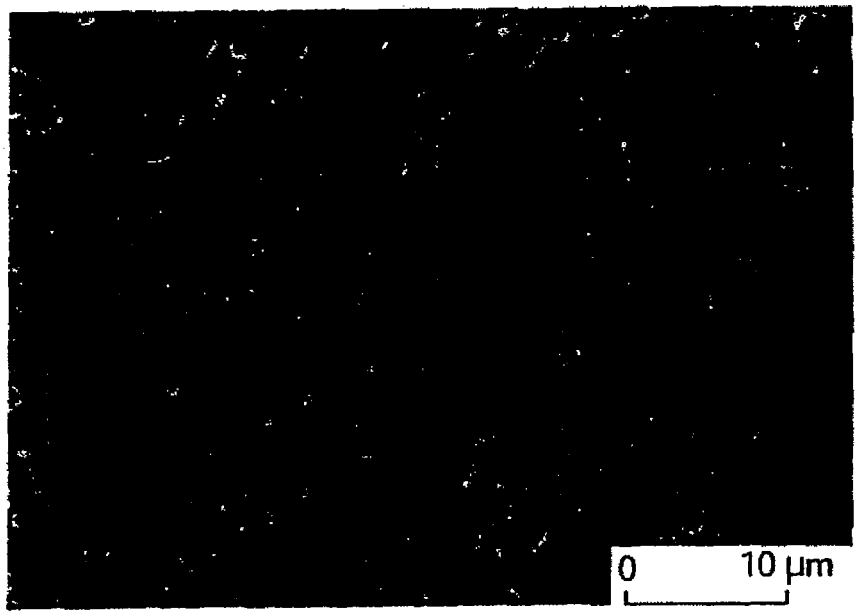
FIG. 3*b*: A micrograph of an alloy according to the disclosure (PM).

Because nickel does not participate in the carbide formation and is completely dissolved in the metal matrix, the structure of the conventional Ni-free steel X230CrVMo13-4 and the alloy according to the disclosure are similar with respect to the carbide type, size and volume content. FIG. 3 depicts corresponding structures of the corresponding commercially available steel and the alloy according to the disclosure.

TABLE 1

Maximum through-hardenable diameter of cylindrical bodies, in mm, with cooling in air and oil for a commercially obtainable PM steel and an alloy variant according to the disclosure for selected cooling parameters λ.

| Designation | Alloy | Cooling parameter λ | Air | Oil |
|---|---|---|---|---|
| 1.2380 | X230CrVMo13-4 | 9 | 65 | 320 |
| PM1 | X250CrNiVMo13-3-2-2 | 55 | 300 | 900 |
| 1.2380 | X230CrVMo13-4 | 9 | 65 | 320 |
| PM1 | X250CrNiVMo13-3-2-2 | 55 | 300 | 900 |

The invention claimed is:

1. A component comprising a wear-resistant powder-metallurgically produced material comprising an alloy that contains:

| | |
|---|---|
| 1.5-5.5 wt. % | carbon |
| 0.1-2.0 wt. % | silicon |
| max. 2.0 wt. % | manganese |
| 3.5-30.0 wt. % | chromium |
| 0.3-10 wt. % | molybdenum |
| 0-10 wt. % | tungsten |
| 0.1-30 wt. % | vanadium |
| 0-12 wt. % | niobium |
| 0.1-12 wt. % | titanium |
| 1.3-3.5 wt. % | nickel |
| 1-6 wt. % | cobalt |
| 0.3-3.5 wt. % | nitrogen |

with the remainder being comprised of iron and production-related impurities, wherein:

$$CAlloy[w\ \%]=S1+S2+S3$$

where:

$S1=(Nb+2(Ti+V-0.9))/a$ $S2=(Mo+W/2+Cr-b)/5$ $S3=c+(TH-900)\cdot 0.0025$ wherein $7<a<9$ $6<b<8$ $0.3<c<0.5$ $900°\ C.<TH<1{,}220°\ C.$

2. The component of claim 1, wherein the component comprises solid or segmented rings and the solid or segmented rings are arranged on one of solid or hollow roll bodies by being shrunk on.

3. The component of claim 1, wherein the content of vanadium is from 0.1 wt. % to less than 11.5 wt. %.

4. The component of claim 1, wherein the alloy comprises:

| | |
|---|---|
| 2.0-2.5 wt. % | carbon |
| 0.1-1.0 wt. % | silicon |
| max. 0.6 wt. % | manganese |

-continued

| | | |
|---|---|---|
| 12.0-14.0 | wt. % | chromium |
| 1.0-2.0 | wt. % | molybdenum |
| 1.1-4.2 | wt. % | vanadium |
| 2.0-3.5 | wt. % | nickel |
| 1.0-6.0 | wt. % | cobalt |
| 0.3-3.5 | wt. % | nitrogen. |

5. The component of claim 1, wherein the nickel content is between 1.5 and 3.0 wt. %.

6. The component of claim 1, wherein the nickel content is between 1.3 and 2.0 wt. %.

7. The component of claim 1, wherein the nickel content is between 2.0 and 3.5 wt. %.

8. The component of claim 1, wherein the content of the vanadium is from 0.1 wt. % to less than 9.5 wt. %.

9. The component of claim 1, wherein the content of the vanadium is from 0.1 wt. % to less than 6.0 wt. %.

10. The component of claim 1, wherein the component is martensitic through-hardened.

11. The component of claim 1, wherein the component is martensitic hardened to a diameter of about 300 mm when the wear resistant material is quenched in air.

12. The component of claim 1, wherein the component is selected from the group consisting of solid rolls, hollow rolls, solid rings arranged on solid or hollow roll bodies, and segmented rings which are arranged on solid or hollow roll bodies.

13. The component of claim 1, wherein the component has a diameter of at least 300 mm.

14. The component of claim 1, wherein the component comprises a core and the core is through-hardened.

15. The component of claim 1, wherein the component is a composite component comprising a layer element, and the layer element is formed of the wear-resistant material.

16. The component of claim 1, wherein the alloy comprises 0 wt % Nb.

17. The component of claim 1, wherein the carbon content is provided in an amount effective for expanding the austenite range.

18. A component comprising a wear-resistant powder-metallurgically produced material comprising an alloy that contains,

| | | |
|---|---|---|
| 1.5-5.5 | wt. % | carbon |
| 0.1-2.0 | wt. % | silicon |
| max. 2.0 | wt. % | manganese |
| greater than 12-30.0 | wt. % | chromium |
| 0.3-10 | wt. % | molybdenum |
| 0-10 | wt. % | tungsten |
| 0.1-30 | wt. % | vanadium |
| 0-12 | wt. % | niobium |
| 0.1-12 | wt. % | titanium |
| 1.3-3.5 | wt. % | nickel |
| 1-6 | wt. % | cobalt |
| 0.3-3.5 | wt. % | nitrogen |

with the remainder being comprised of iron and production-related impurities, wherein:

$$CAlloy[w\ \%]=S1+S2K+S3 \text{ is fulfilled, wherein}$$

$$S1=(Nb+2(Ti+V-0.9))/a$$

$$S2K=(Mo+W/2+Cr-b-12)/5,$$

$$S3=c+(TH-900)\cdot 0.0025$$

with $7<a<9$, $6<b<8$, $0.3<c<0.5$, $900^\circ\ C.<TH<1{,}220^\circ\ C.$

19. The component of claim 18, wherein the carbon content is provided in an amount effective for expanding the austenite range.

* * * * *